US005448795A

United States Patent [19]

Boughal

[11] Patent Number: 5,448,795

[45] Date of Patent: Sep. 12, 1995

[54] CONDENSER TUBE CLEANER

[76] Inventor: Sean Boughal, 41 Joseph St., Sayville, N.Y. 11782

[21] Appl. No.: 282,603

[22] Filed: Jul. 29, 1994

[51] Int. Cl.[6] ..... B05C 7/00

[52] U.S. Cl. ..... 15/406; 134/169 C; 134/113; 15/3.51

[58] Field of Search ..... 15/104.061, 104.063, 15/304, 3.51, 3.52, 3.5, 406; 134/166 C, 169 C, 113

[56] References Cited

U.S. PATENT DOCUMENTS

| | | | |
|---|---|---|---|
| 1,510,212 | 9/1924 | Du Bois | 15/406 |
| 1,806,270 | 5/1931 | Thompson | 15/3.5 |
| 1,808,870 | 6/1931 | Strasburg | 15/3.5 |
| 1,867,751 | 7/1932 | Oberhuber | 15/3.5 |
| 1,893,979 | 1/1933 | Barrere | 134/167 C |
| 3,075,535 | 1/1963 | Lasting | 134/167 C |
| 3,426,774 | 2/1969 | Conn | 15/406 |
| 3,789,861 | 2/1974 | Conn et al. | 15/406 |
| 4,137,928 | 2/1979 | Sentell | 134/167 C |
| 4,429,428 | 2/1984 | Van Dyk | 15/3.52 |
| 4,467,488 | 8/1984 | Creek | 15/3.5 |

*Primary Examiner*—David A. Scherbel
*Assistant Examiner*—Tony G. Soohoo
*Attorney, Agent, or Firm*—Richard L. Miller

[57] ABSTRACT

A condenser cleaner, for cleaning a condenser tube having a condenser tube opening using high pressure medium supplied from a high pressure source, comprising a high pressure gun, a penetrator tube, and a sealing mechanism. The penetrator tube has a penetrator tube opening on one end and a threaded socket on another end. The penetrator tube opening is in communication with the threaded socket. The high pressure gun has a central conduit connected to the high pressure source at a primary conduit through a central conduit valve. The high pressure gun has a nozzle head in communication with the central conduit. The nozzle head is attached to the threaded socket, bringing it into communication with the central conduit. The sealing mechanism includes an expandable seal which is in communication with the primary conduit to expand the expandable seal against the condenser tube wall, creating a tight seal therewith.

5 Claims, 2 Drawing Sheets

FIG. 1
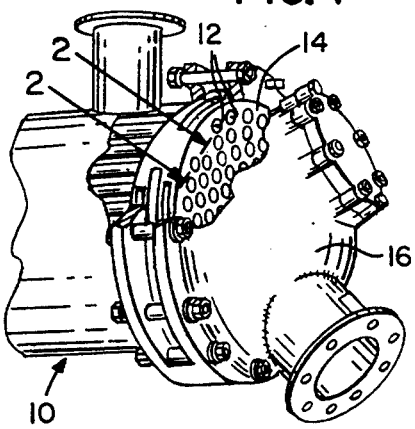
FIG. 2
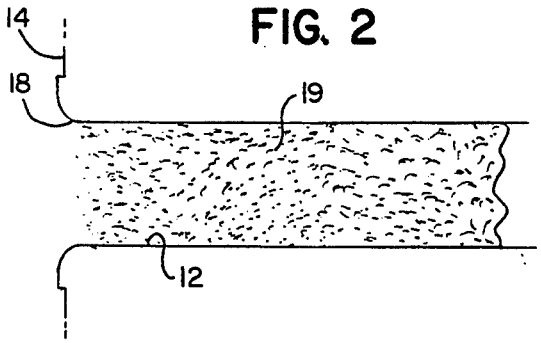
FIG. 3
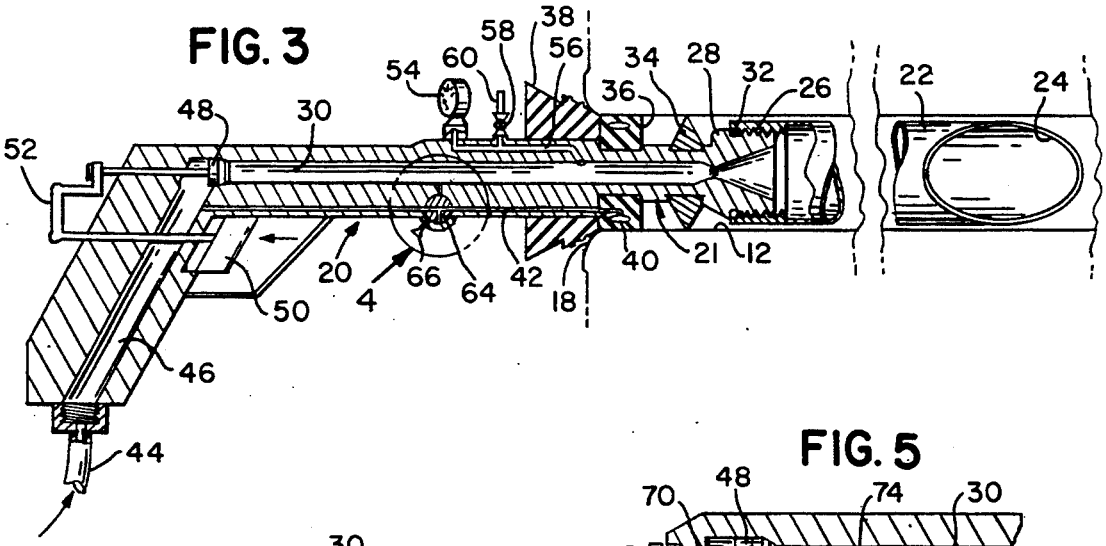
FIG. 5
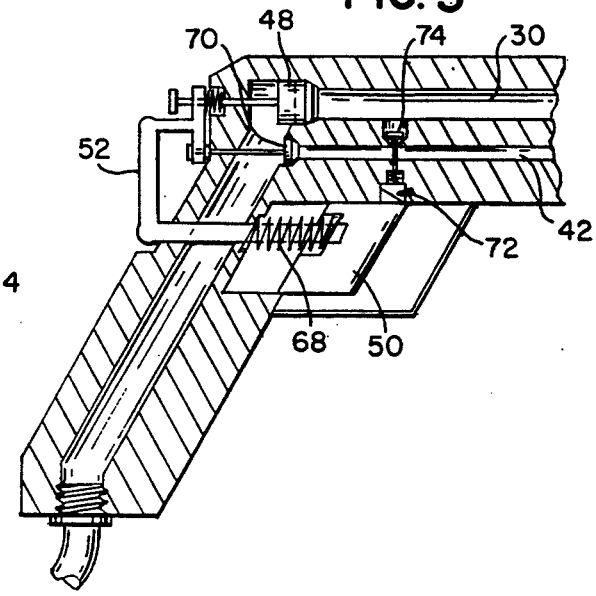
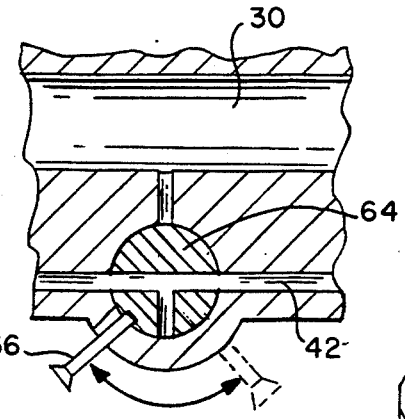
FIG. 4

CONDENSER TUBE CLEANER

CROSS REFERENCES

The instant invention is the subject matter of Disclosure Document No.: 332557, filed in the PTO on Jun. 14, 1993, and it is respectfully requested that this document be retained beyond the two-year period so that it may be relied upon as evidence of conception of the invention during the prosecution phase of this application, should the need arise.

BACKGROUND OF THE INVENTION

The invention relates to a condenser tube cleaner, more particularly, the invention relates to a high pressure device for clearing condenser or heat exchanger tubes.

Heat exchanger and condenser tubes that are subjected to sea water and other concentrated solutions have a great tendency of becoming clogged. Sediments of cement-like substances can foul and plug these tubes. In addition deposits of slime, marine growth, scale, mud, and oil can build up in the tubes. A thin deposit on the condenser tube wall greatly reduces the thermal conductivity through the tube wall, severely inhibiting the efficiency of the heat exchange or condensing operation.

In ships, the condenser tubes become fouled quickly, and should be cleaned as often as necessary. In order to clean the condenser tubes, the power plant must be taken off line. The cleaning operation is normally time consuming. Taking the power plant off line at sea can be very expensive, and creates safety hazards.

Cleaning the condenser tubes is usually conducted by scrubbing the interior of the tubes with a rotating bristle brush, by air lance, or by propelling soft rubber plugs through the tubes with compressed air or water. While these methods may be suitable for the particular purpose employed, or for general use, they would not be as suitable for the purposes of the present invention as disclosed hereafter.

SUMMARY OF THE INVENTION

It is an object of the invention to provide a condenser tube cleaner that quickly and thoroughly clears condenser tubes of sediments and other substances that build up in the tubes.

It is another object of the invention to provide a condenser tube cleaner that creates a tight seal with a condenser tube and then removes clogging substances with a high pressure jet.

It is a further object of the invention to provide a condenser tube cleaner that automatically seals to the condenser tubes prior to cleaning, and automatically unseals after the cleaning operation.

It is a still further object of the invention to produce a condenser tube cleaner that can safely, easily, and quickly clean a condenser tube.

The invention is a condenser cleaner, for cleaning a condenser tube having a condenser tube opening using high pressure medium supplied from a high pressure source, comprising a high pressure gun, a penetrator tube, and a sealing mechanism. The penetrator tube has a penetrator tube opening on one end and a threaded socket on another end. The penetrator tube opening is in communication with the threaded socket. The high pressure gun has a central conduit connected to the high pressure source at a primary conduit through a central conduit valve. The high pressure gun has a nozzle head in communication with the central conduit. The nozzle head is attached to the threaded socket, bringing it into communication with the central conduit. The sealing mechanism includes an expandable seal which is in communication with the primary conduit to expand the expandable seal against the condenser tube wall, creating a tight seal therewith.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like reference numerals depict like elements throughout the several views. The drawings are briefly described below.

FIG. 1 is a diagrammatic perspective view of a typical heat exchanger on which the instant invention may be used.

FIG. 2 is a diagrammatic cross sectional view, illustrating a typical tube with debris in it taken on line 2—2 of FIG. 1.

FIG. 3 is a diagrammatic cross sectional view of a first embodiment of the instant invention.

FIG. 4 is an enlarged diagrammatic view of the valve shown in the area enclosed by the dotted circle indicated by arrow 4 in FIG. 3.

FIG. 5 is a diagrammatic cross sectional view with parts broken away of a second embodiment of the instant invention.

DETAILED DESCRIPTION OF THE PREFERRED EMBODIMENTS

Figure 6:
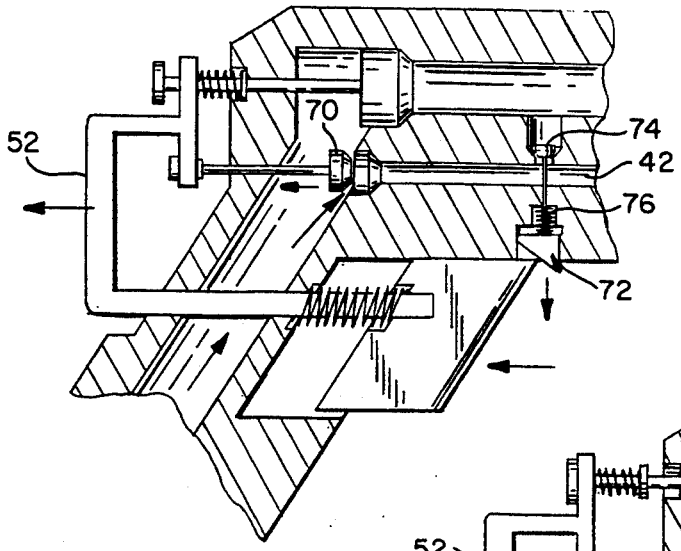
FIG. 6 is a diagrammatic cross sectional view similar to FIG. 5, but illustrating the trigger partially depressed so that the expandable seal is expanded.

FIG. 1 illustrates a typical straight tube heat exchanger 10. The heat exchanger 10 has a plurality of condenser tubes 12, which terminate at a tube sheet 14. The tube sheet is normally covered by a water chest 16, shown in FIG. 1 partially broken away.

FIG. 2 illustrates a condenser tube 12, having a condenser tube opening 18. The condenser tube opening 18 is at the tube sheet 14. As illustrated in FIG. 2, the condenser tube is fouled with contaminants 19.

FIG. 3 illustrates a condenser cleaner 20 inserted into the condenser tube opening 18 of a condenser tube 12.

The condenser cleaner 20 has a high pressure gun 21 and a tube penetrator 22. The tube penetrator 22 is a hollow cylinder, and has a tube penetrator opening 24. The tube penetrator opening 24 is at a distal end of the condenser cleaner 20. The tube penetrator 22 is made of a material that is softer than the condenser tube 12 into which it is to be inserted, to prevent damage to the condenser tube.

The tube penetrator 22 is of a slightly smaller diameter than the condenser tube 12, allowing it to clear the condenser tube opening 18 as it is inserted into the condenser tube 12, and also reducing the amount of backflow from the tube penetrator opening 24 toward the condenser tube opening 18.

The tube penetrator 22 has a threaded socket 26 at an end of the tube penetrator 22 opposite the tube penetrator opening 24. The tube penetrator opening 24 is in fluid communication with the threaded socket 26.

The threaded socket 26 screws onto a nozzle head 28 of the high pressure gun 21. The high pressure gun 21 has a central conduit 30 in fluid communication with the nozzle head 28, which is also brought into fluid communication with the tube penetrator 22 at the threaded socket 26. A seal is created with an O-ring 32 at the interface of the threaded socket 26 and nozzle head 28.

In order to create a tight seal with the condenser tube 12, the condenser cleaner 20 has a sealing mechanism attached to the high pressure gun. The sealing mechanism comprises a scraper seal 34 an expandable seal 36 and a tube plug 38.

The scraper seal 34 encircles the high pressure gun 21 just proximal of the nozzle head 28. The scraper seal 34 has a triangular toroidal shape. The scraper seal 34 helps clear the condenser tube 12 of debris, and greatly reduces backwash from the tube penetrator opening 24.

The expandable seal 36 encircles the high pressure gun 21 proximal of the scraper seal 34. The expandable seal is of a generally toroidal shape, and has an internal bladder 40 that is in fluid communication with a secondary conduit 42 in the high pressure gun 21. The expandable seal is made of a flexible rubber material. Upon the presence of high pressure liquid or gas in the secondary conduit 42, the bladder 40 expands, expanding the expandable seal 36 against the condenser tube 12.

The tube plug 38 is located just proximal of the expandable seal 36. The tube plug 38 is tapered toward the distal end of the condenser cleaner 20. The tube plug 38 limits the insertion of the condenser cleaner 20 into the condenser tube 12, and creates a final seal at the condenser tube opening 18.

High pressure medium, such as compressed air or liquid is supplied by a high pressure source 44 to a primary conduit 46. The primary conduit 46 is in communication with the secondary conduit 42, and is in communication with the central conduit 30 through a central conduit valve 48. The central conduit valve 48 is actuated by a trigger 50 through a linkage 52.

A pressure gauge 54 is in communication with the primary conduit through a relief conduit 56. A relief valve 58 is in communication the relief conduit 56. When pressure in the primary conduit becomes too great, discharge through a discharge tube 60 connected to the relief valve will relieve pressure from the primary conduit.

In the first embodiment, continuity of the secondary conduit 42 can be interrupted by a rotary valve 64. The rotary valve 64 is actuated by a rotary valve lever 66.

FIG. 4 is a detail of the rotary valve 64 of the first embodiment. The rotary valve lever 66 selectively moves the rotary valve to a first rotary valve position, where it provides a continuous connection for the secondary conduit 42, allowing the expandable seal 36 to expand. The rotary valve lever 66 also selectively moves the rotary valve 64 to a second rotary valve position, where it brings the expandable seal 36 in communication with the central conduit 30.

The operation of the first embodiment of the condenser cleaner 20 is described as follows:

The tube penetrator 22 at the distal end of the condenser cleaner 20 is inserted into the condenser tube 12 until the insertion of the condenser cleaner 20 into the condenser tube opening 18 is limited by the tube plug 38.

The rotary valve is brought into the first rotary valve position, where it allows continuous flow through the secondary conduit 42, pressurizing the bladder 40, expanding the expandable seal 36 against the condenser tube 12, creating a tight seal therewith. The trigger 50 actuates the central conduit valve 48. When open, the central conduit valve 48 allows high pressure gas or liquid from the primary conduit 46 to enter the central conduit, and then travel out the tube penetrator opening 24.

Following the condenser tube 12 cleaning, the trigger 50 is released, closing the central conduit valve 48. The pressure in the central conduit naturally decreases due to communication with the un-pressurized condenser tube 12. The rotary valve lever 66 is operated to bring the rotary valve 64 into the second rotary valve position, where it allows pressure from the bladder 40 to release into the central conduit 30, relieving the pressure of the expandable seal 36 against the condenser tube 12. The condenser cleaner 20 is then withdrawn from the condenser tube 12.

FIG. 5 illustrates a second embodiment of the condenser cleaner 20, in which the expandable seal 36 is automatically expanded and un-expanded.

In this embodiment, the trigger 50 is connected to the linkage 52 through a trigger spring 68. In addition to operating the central conduit valve 48, the linkage 52 also operates a secondary conduit valve 70. The secondary conduit valve 70 allows high pressure medium from the primary conduit to enter the secondary conduit 42 and expand the expandable seal 36.

As shown in FIG. 5, the trigger 40 is in a first trigger position, where both the central conduit valve 48 and the secondary conduit valve 70 are closed. The central conduit 30 is not pressurized.

However, in the first trigger position, the trigger 50 has operated a bladder release valve 72, which operates a poppet 74, bringing the secondary conduit 42 into communication with the un-pressurized central conduit 30, in effect, unexpanding the bladder 40 in the expandable seal 36.

FIG. 6 illustrates the trigger 50 in a second trigger position, where the poppet 74 has been restored by a poppet spring 76, closing the bladder release valve 72. In the second trigger position the secondary conduit valve 70 is opened by the linkage 52, pressurizing the secondary conduit 42, and expanding the bladder 40 in the expandable seal 36, so that the expandable seal 36 creates a tight seal with the condenser tube 12.

Figure 7:
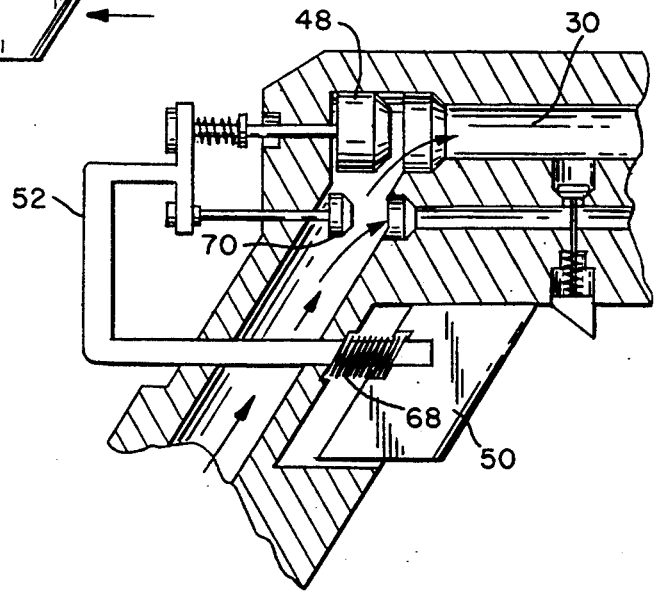
FIG. 7 is a diagrammatic cross sectional view similar to FIG. 5, but illustrating the trigger fully depressed so that fluid is forced into a heat exchanger tube.

FIG. 7 illustrates the trigger 50 in a third trigger position, where it causes the linkage 52 to open the central conduit valve 48, pressurizing the central conduit 30, expelling pressurized air through the tube penetrator opening 24 to perform the cleaning operation. The secondary conduit valve 70 remains open while the trigger 50 is in the third position.

When the trigger 50 is released, the trigger spring 68 restores the trigger 50 to the first trigger position that is shown in FIG. 5. The linkage 52 closes the central conduit valve 48 and secondary valve 70, depressurizing the central conduit. The trigger 50 opens the bladder release valve 72, operating the poppet 74, releasing the pressure in the bladder 40. When the pressure in the bladder 40 is released, the expandable seal 36 unexpands, allowing the condenser cleaner 20 to be withdrawn from the condenser tube 12.

Figure 8:
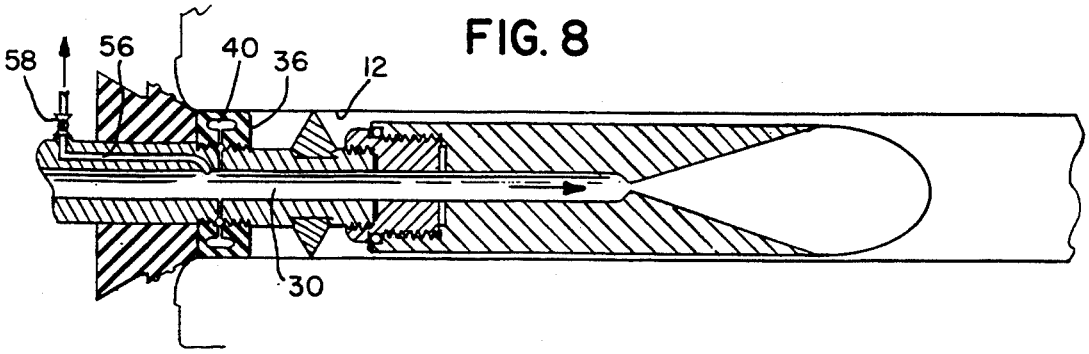
FIG. 8 is a diagrammatic cross sectional view illustrating how an embodiment of the instant invention may have a longer tube penetrator so as to be extended further into a typical heat exchanger tube.

FIG. 8 illustrates a third embodiment of the condenser cleaner 20 in which the bladder 40 is in direct communication with the central conduit 30. The bladder 40 is expanded when the central conduit 30 is pressurized, and is unexpanded when the central conduit 30 is no longer pressurized. Further illustrated is the relief valve attached to the central conduit 30 through the relief conduit 56. The pressure gauge is omitted in this embodiment, since the primary purpose of the relief valve is to depressurize the bladder if a clog in the condenser tube 12 prevents depressurization of the bladder 40 through the central conduit.

In addition, in the embodiment shown in FIG. 8, the tube penetrator 22 is longer than in the embodiments shown in the other drawing figures. A longer tube penetrator 22 allows the tube penetrator to be inserted further into the condenser tube 12.

What is claimed is:

1. A condenser cleaner for cleaning a condenser tube having a condenser tube opening using a high pressure medium supplied from a high pressure source comprising:

a) a high pressure gun and a means for supplying high pressure medium, the high pressure gun having a primary conduit, a means connecting the primary conduit to said means for supplying high pressure medium, a central conduit having a first end connected to the primary conduit, a central conduit valve located between the primary conduit and the central conduit, and being operable to selectively provide a fluid connection between the central conduit and the primary conduit, and a nozzle head connected to the central conduit at a second end of said central conduit;

b) a penetrator tube having approximately the same diameter as the condenser tube, the penetrator tube having a penetrator opening at one end and a threaded socket at another end, said threaded socket attaching said penetrator tube to the nozzle head; and c) a sealing means attached to the high pressure gun near the nozzle head for creating a tight seal between the high pressure gun and the condenser tube, the sealing means comprising an expandable seal encircling the high pressure gun and having an internal bladder, the internal bladder further being connected with the primary conduit through a secondary conduit for providing said pressurized medium from said primary conduit to expand the expandable seal against the condenser tube to form a tight seal therewith, the secondary conduit further comprising a secondary conduit valve to selectively allow high pressure medium from the primary conduit to enter the secondary conduit; and d) a trigger assembly for selectively controlling said central conduit valve and said second conduit valve, said trigger assembly having a first trigger position, a second trigger position, and a third trigger position, whereby when said trigger assembly is disposed in the first trigger position the secondary conduit valve and central conduit valve are both closed, in the second trigger position the trigger assembly opens the second conduit valve allowing the bladder to pressurize and expand the expandable seal, and in the third trigger position the trigger opens the central conduit valve.

2. The apparatus as recited in claim 1, further comprising a bladder relief valve, the bladder relief valve being operable to connect selectively the secondary conduit with the central conduit; said bladder relief valve being operatively connected to said trigger assembly such that when said trigger assembly is in the first trigger position the bladder relief valve is opened to connect the secondary conduit with the central conduit when said secondary conduit valve and central conduit valve are both closed.

3. The apparatus as recited in claim 2, further comprising a pressure gauge operably connected with the central conduit and a relief valve operably connected with the central conduit whereby said relief valve may be operated to selectively provide a release of pressure within the central conduit.

4. The apparatus as recited in claim 1, further comprising a pressure gauge operably connected with the central conduit and a relief valve operably connected with the central conduit whereby said relief valve may be operated to selectively provide a release of pressure within the central conduit.

5. The apparatus as recited in claim 1, further comprising a relief valve operably connected with the central conduit whereby said relief valve may be operated to selectively provide a release of pressure within the central conduit.

* * * * *